US010119220B2

(12) United States Patent
Lee et al.

(10) Patent No.: US 10,119,220 B2
(45) Date of Patent: Nov. 6, 2018

(54) LAUNDRY TREATMENT APPARATUS

(71) Applicant: LG Electronics Inc., Seoul (KR)

(72) Inventors: Jihong Lee, Seoul (KR); Byungjin Lee, Seoul (KR); Hongchul Kim, Seoul (KR); Kwanwoong Jeong, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 0 days.

(21) Appl. No.: 15/547,893

(22) PCT Filed: Feb. 29, 2016

(86) PCT No.: PCT/KR2016/002012
§ 371 (c)(1),
(2) Date: Aug. 1, 2017

(87) PCT Pub. No.: WO2016/140484
PCT Pub. Date: Sep. 9, 2016

(65) Prior Publication Data

US 2018/0023241 A1 Jan. 25, 2018

(30) Foreign Application Priority Data

Mar. 2, 2015 (KR) ..... 10-2015-0028984

(51) Int. Cl.
*D06F 39/00* (2006.01)
*D06F 39/14* (2006.01)
(Continued)

(52) U.S. Cl.
CPC ..... *D06F 39/14* (2013.01); *D06F 29/005* (2013.01); *D06F 37/04* (2013.01); *D06F 37/12* (2013.01); *E05C 19/16* (2013.01)

(58) Field of Classification Search
CPC ..... D06F 39/14; D06F 37/08; D06F 37/10; D06F 37/28; D06F 29/005; E05C 19/16
See application file for complete search history.

(56) References Cited

U.S. PATENT DOCUMENTS 3,468,576 A * 9/1969 Beyer ..... E05C 19/16 220/230
9,752,267 B2 * 9/2017 Lee ..... D06F 37/267
(Continued)

FOREIGN PATENT DOCUMENTS

JP 2003220295 A 8/2003
KR 20-1999-0037510 U 10/1999
(Continued)

*Primary Examiner* — Daniel J Rohrhoff
(74) *Attorney, Agent, or Firm* — Dentons US LLP

(57) ABSTRACT

A laundry treatment apparatus is disclosed. The laundry treatment apparatus includes a receiving unit for providing a laundry receiving space, an introduction port for allowing the receiving unit to communicate with the outside of the laundry treatment apparatus, a door for opening and closing the introduction port, an actuation unit provided at the door such that the actuation unit reciprocates between a first position and a second position, and a fixing unit for fixing the door to the introduction port using an attractive force when the actuation unit is positioned at the first position and for separating the door from the introduction port when the actuation unit is positioned at the second position.

10 Claims, 4 Drawing Sheets

(51) Int. Cl.

| | |
|---|---|
| ***D06F 29/00*** | (2006.01) |
| ***E05C 19/16*** | (2006.01) |
| ***D06F 37/12*** | (2006.01) |
| ***D06F 37/04*** | (2006.01) |

(56) References Cited

U.S. PATENT DOCUMENTS

2007/0138806 A1* 6/2007 Ligtenberg ..... E05C 19/16 292/251.5
2008/0061565 A1* 3/2008 Lee ..... E05C 19/16 292/251.5
2009/0145174 A1* 6/2009 Kim ..... D06F 23/02 68/27
2009/0145177 A1 6/2009 Kim et al.
2010/0283269 A1* 11/2010 Fiedler ..... A44B 11/258 292/251.5
2011/0265524 A1 11/2011 Kim et al.
2011/0298338 A1* 12/2011 Kim ..... D06F 29/00 312/109
2013/0099644 A1* 4/2013 Takeuchi ..... E05C 19/16 312/326
2015/0115630 A1* 4/2015 Tarr ..... E05C 19/16 292/251.5
2015/0376828 A1* 12/2015 Seo ..... D06F 29/00 68/3 R
2017/0002503 A1* 1/2017 Jeong ..... D06F 37/12
2017/0356115 A1* 12/2017 Choi ..... D06F 29/02
2018/0023241 A1* 1/2018 Lee ..... D06F 39/14

FOREIGN PATENT DOCUMENTS

KR 10-0759752 B1 9/2007
KR 1020100110503 A 10/2010
KR 1020110028899 A 3/2011
KR 1020110043001 A 4/2011
KR 10-1139445 B1 4/2012
KR 10-1490184 B1 2/2015

* cited by examiner

[Fig. 1]
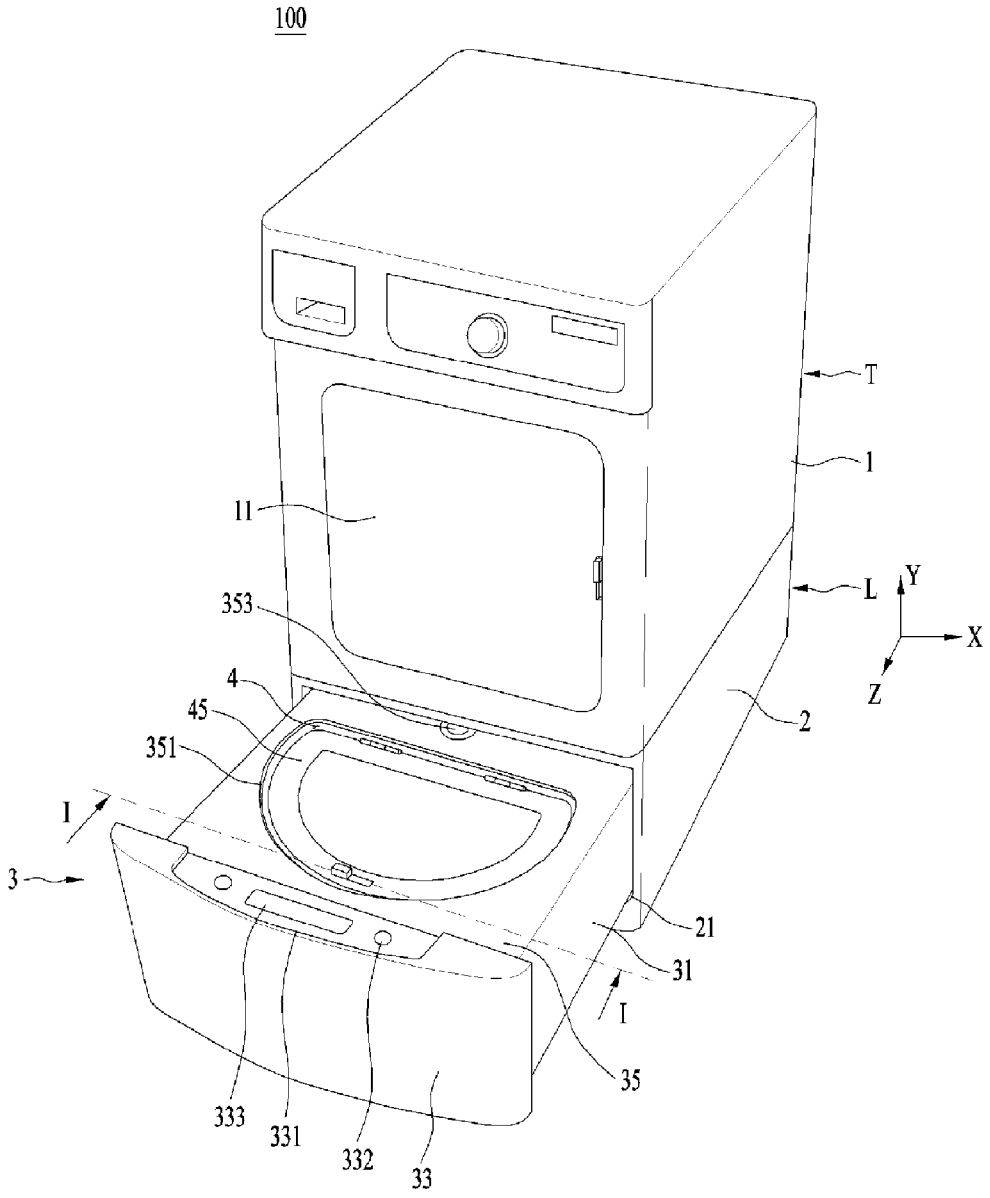

[Fig. 2]
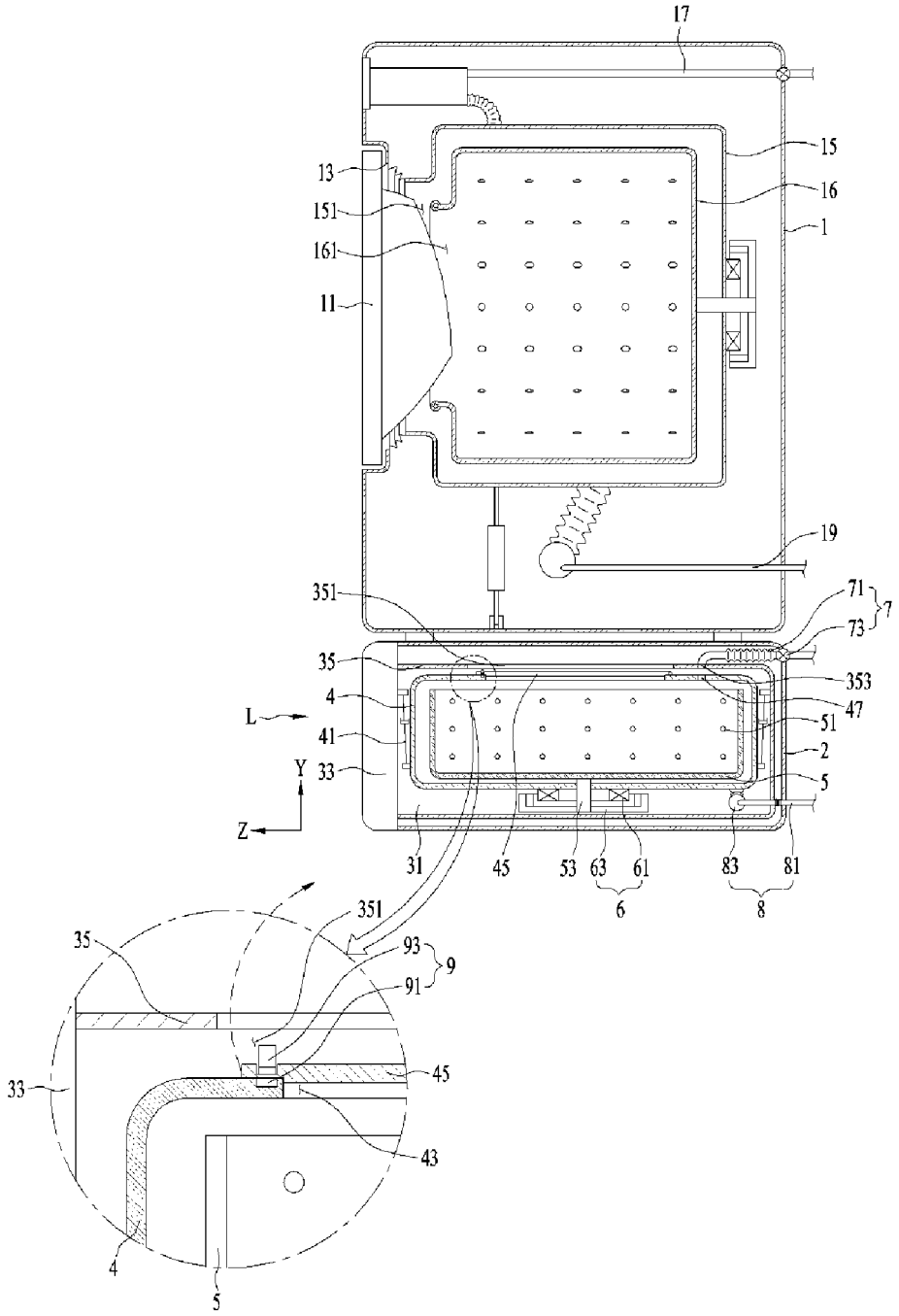

[Fig. 3]
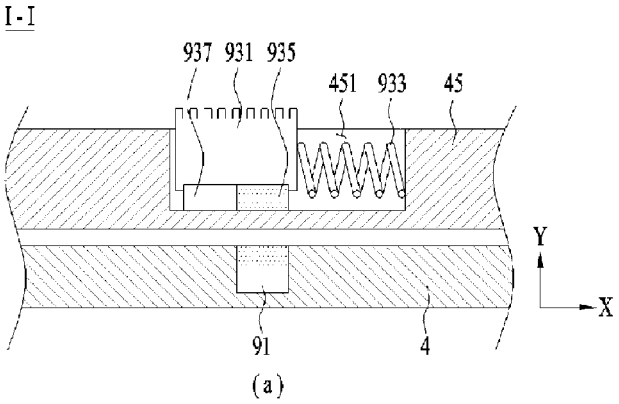
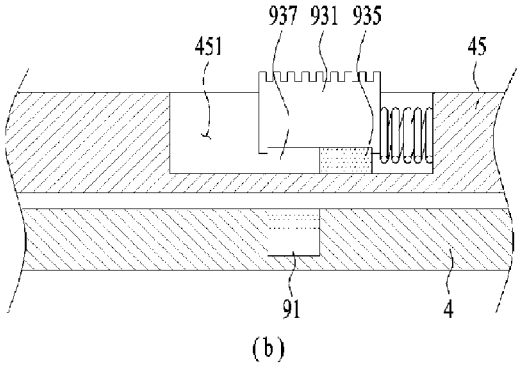
[Fig. 4]
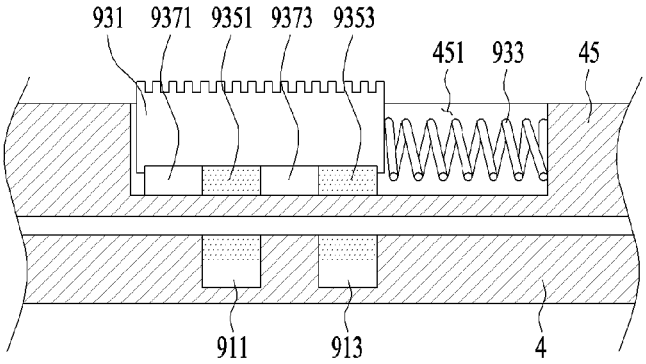

[Fig. 5]
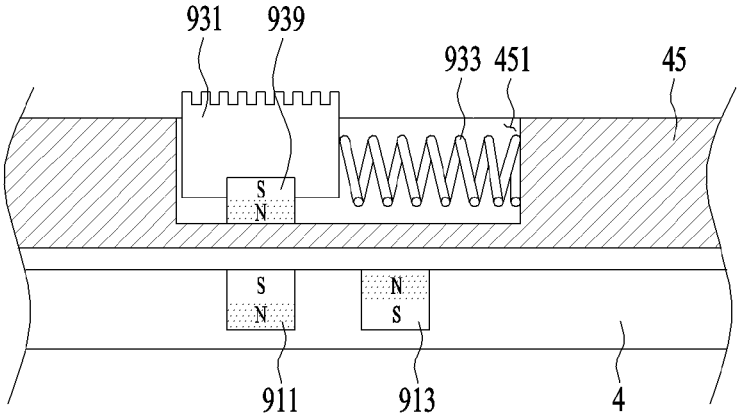

LAUNDRY TREATMENT APPARATUS

This application is a National Stage Application of International Application No. PCT/KR2016/002012, filed on Feb. 19, 2016, which claims the benefit of Korean Patent Application No. 10-2015-0028984, filed on Mar. 2, 2015, all of which are hereby incorporated by reference in their entirety for all purposes as if fully set forth herein.

TECHNICAL FIELD

The present invention relates to a laundry treatment apparatus.

BACKGROUND ART

A laundry treatment apparatus is an electrical household appliance which may be used for washing laundry. In some examples, a laundry treatment apparatus may be an apparatus for drying laundry, or an apparatus for washing and drying laundry.

In a front loading type laundry treatment apparatus, for example, a drum type washing machine, where laundry is introduced into the laundry treatment apparatus through the front of the apparatus, an introduction port, through which laundry is introduced into the laundry treatment apparatus, is lower than the waist of a user, with the result that the user must stoop to introduce laundry into the laundry treatment apparatus or to remove laundry from the laundry treatment apparatus, which is inconvenient.

Some conventional front loading type laundry treatment apparatuses are provided with a pedestal, which is disposed under the laundry treatment apparatus in order to increase the height of the introduction port of the laundry treatment apparatus.

In some other laundry treatment apparatuses, the introduction port is opened and closed by a door, which is fixed to a cabinet via a door lock.

The door lock includes a hook provided at the door and a recess provided in the cabinet such that the hook can be separably inserted into the recess. In the door lock, which includes the hook and the recess, however, a gap exists between the door and the introduction port, with the result that, when vibration is generated from the laundry treatment apparatus, noise may also be generated from the laundry treatment apparatus, or the door lock may break.

DISCLOSURE OF INVENTION

Technical Problem

An object of the present invention devised to solve the problem lies in a laundry treatment apparatus having a door lock that is capable of minimizing a gap between an introduction port and a door.

Another object of the present invention devised to solve the problem lies in a laundry treatment apparatus located under a first treatment device for treating laundry in order to increase the height of an introduction port of the first treatment device and, additionally, to wash and dry laundry.

Solution to Problem

The object of the present invention can be achieved by providing a laundry treatment apparatus including a receiving unit configured to receive laundry; an introduction port configured to allow the receiving unit to communicate with an outside of the laundry treatment apparatus; a door configured to open and close the introduction port; an actuation unit provided at the door and configured to move between a first position and a second position; and a fixing unit that is configured to fix the door to the introduction port by an attractive force based on the actuation unit being positioned at the first position, and that is configured to separate the door from the introduction port based on the actuation unit being positioned at the second position.

The actuation unit may include an actuation body provided at the door and a magnetic body fixed to the actuation body, the actuation body being configured to move between the first position and the second position, and the fixing unit comprises a magnet fixed to the receiving unit and configured to apply an attractive force to the magnetic body based on the actuation body being moved to the first position.

The actuation unit may further include a non-magnetic body fixed to the actuation body, the non-magnetic body being configured to face the magnet based on the actuation body being moved to the second position.

The magnetic body may include a first magnetic body and a second magnetic body fixed to the actuation body such that the first magnetic body and the second magnetic body are spaced apart from each other by a predetermined distance, and the magnet may include a first magnet configured to face the first magnetic body based on the actuation body being positioned at the first position, and a second magnet configured to face the second magnetic body based on the actuation body being positioned at the first position.

The actuation unit may further include a non-magnetic body provided between the first magnetic body and the second magnetic body such that the non-magnetic body is configured to face the first magnet or the second magnet based on the actuation body being moved to the second position.

The fixing unit comprises a magnetic body fixed to the receiving unit, and the actuation unit may include an actuation body provided at the door and a magnet fixed to the actuation body, the actuation body being configured to move between the first position and the second position, and the magnet being configured to apply an attractive force to the magnetic body based on the actuation body being moved to the first position.

The fixing unit may further include a non-magnetic body fixed to the receiving unit such that the non-magnetic body is configured to face the magnet based on the actuation body being moved to the second position.

The actuation unit may include an actuation body provided at the door and an actuation unit magnet fixed to the actuation body, the actuation body being configured to move between the first position and the second position, and the fixing unit may include a first fixing unit magnet fixed to the receiving unit and configured to apply an attractive force to the actuation unit magnet based on the actuation body being moved to the first position, and a second fixing unit magnet fixed to the receiving unit and configured to apply a repulsive force to the actuation unit magnet based on the actuation body being moved to the second position.

The fixing unit may include a fixing unit magnet fixed to the receiving unit, the actuation unit may include an actuation body provided at the door, the actuation body being configured to move between the first position and the second position, and the actuation unit may further include a first actuation unit magnet fixed to the actuation body and configured to apply an attractive force to the fixing unit magnet based on the actuation body being moved to the first position, and a second actuation unit magnet fixed to the actuation body and configured to apply a repulsive force to the fixing unit magnet based on the actuation body being moved to the second position.

The laundry treatment apparatus may further include an actuation body receiving unit that is provided in the door and that is configured to receive the actuation body; and an actuation body support unit provided in the actuation body receiving unit and that is configured to push the actuation body to the first position while elastically supporting the actuation body.

The laundry treatment apparatus may further include a cabinet configured to provide a space to receive the receiving unit; and a through hole provided in the cabinet and configured to communicate with the introduction port.

The laundry treatment apparatus may further include a cabinet; a drawer provided in the cabinet and configured to provide a space to receive the receiving unit; and a through hole provided in the drawer, the through hole being located above the door for allowing the door to be hingedly rotated toward an outside of the drawer.

The fixing unit may be fixed to the receiving unit, and the actuation unit may be configured to move in a width direction of the door or in a height direction of the door.

The actuation unit may be configured to move in a width direction of the door.

The actuation unit may be configured to move in a height direction of the door.

Advantageous Effects of Invention

As is apparent from the above description, the present invention has the effect of providing a laundry treatment apparatus having a door lock that is capable of minimizing a gap between an introduction port and a door.

In addition, the present invention has the effect of providing a laundry treatment apparatus located under a first treatment device for treating laundry in order to increase the height of an introduction port of the first treatment device and, additionally, to wash and dry laundry.

BRIEF DESCRIPTION OF DRAWINGS

FIGS. 1 and 2 are views showing an example of a laundry treatment apparatus;

FIG. 3 is a view showing an example of a door lock provided in the laundry treatment apparatus;

FIG. 4 is a view showing an example of the door lock provided in the laundry treatment apparatus; and FIG. 5 is a view showing an example of the door lock provided in the laundry treatment apparatus.

BEST MODE FOR CARRYING OUT THE INVENTION

As shown in FIG. 1, a laundry treatment apparatus 100 may include both a first treatment device L and a second treatment device T. Alternatively, the laundry treatment apparatus 100 may include one selected from between the first treatment device L and the second treatment device T. Hereinafter, a laundry treatment apparatus 100 including both a first treatment device L and a second treatment device T will be described in detail by way of example for the convenience of description.

The first treatment device L is a device that treats, for example, washes or dries laundry, and the second treatment device T is a device that is separably mounted to the first treatment device L in order to treat laundry.

As shown in FIG. 2, the second treatment device T may include a second treatment device cabinet 1 forming the external appearance of the second treatment device T and a second treatment device receiving unit 15 and 16 provided in the second treatment device cabinet 1 for providing a laundry receiving space.

The second treatment device cabinet 1 is provided with a second treatment device through hole 13 which communicates with the second treatment device receiving unit 15 and 16 for allowing laundry to be introduced into and removed from the second treatment device receiving unit 15 and 16 therethrough.

The second treatment device receiving unit may include a second treatment device tub 15 for receiving wash water and a second treatment device drum 16 rotatably provided in the second treatment device tub 15 for providing a laundry receiving space.

The second treatment device tub 15 may be provided with a second treatment device introduction port 151, which communicates with the second treatment device through hole 13, and the second treatment device drum 16 may be provided with a drum introduction port 161, which communicates with the second treatment device introduction port 151.

The second treatment device cabinet 1 is provided with a second treatment device door 11 for opening and closing the second treatment device introduction port 151. A user may open the second treatment device door 11 in order to introduce laundry into the second treatment device drum 16 or to remove the laundry received in the second treatment device drum 16 out of the second treatment device cabinet 1.

In addition, the second treatment device T may further include a second treatment device water supply unit 17 for supplying wash water to the second treatment device tub 15 and a second treatment device drainage unit 19 for discharging the wash water received in the second treatment device tub 15 out of the second treatment device cabinet 1.

In some examples, where the second treatment device T is configured only to dry laundry, the second treatment device receiving unit may include only a second treatment device drum 16 rotatably provided in the second treatment device cabinet 1.

The second treatment device T may further include a member for rotatably supporting the second treatment device drum 16 and a second treatment device hot air supply unit for supplying heated air into the second treatment device drum 16.

The second treatment device hot air supply unit may include a circulation duct for circulating air in the second treatment device tub 15 and a heat exchange unit provided in the circulation duct for dehumidifying and heating air discharged from the second treatment device tub 15.

The second treatment device hot air supply unit may include a discharge duct for discharging air in the second treatment device tub 15 out of the second treatment device cabinet 1, a supply duct for supplying air outside the second treatment device cabinet 1 into the second treatment device tub 15, and a heat exchange unit for heating air that is introduced into the supply duct.

In some examples where the second treatment device T is configured to both wash and dry laundry, the second treatment device receiving unit may include a second treatment device tub 15 and a second treatment device drum 16, and the second treatment device T may further include a second treatment device water supply unit 17, a second treatment device drainage unit 19, and a second treatment device hot air supply unit.

As shown in FIG. 1, the first treatment device L may include a cabinet 2 for supporting the second treatment device cabinet 1, a drawer 3 provided in the cabinet 2 to be pulled out from the cabinet 2, and a receiving unit 4 and 5 provided in the drawer 3 for providing a laundry treatment space.

The cabinet 2 forms the external appearance of the first treatment device L. The cabinet 2 may be located on the second treatment device T. Alternatively, the cabinet 2 may be located under the second treatment device T.

In a case in which the first treatment device L is located under the second treatment device T, as shown in FIG. 1, the height of the second treatment device door 11 and the second treatment device introduction port 151 is increased due to the first treatment device L, with the result that it is possible for the user to conveniently introduce laundry into the second treatment device T or to conveniently remove the laundry from the second treatment device T.

The cabinet 2 is provided with an open surface 21, through which the drawer 3 may be pulled out from the cabinet 2 or inserted into the cabinet 2. In some examples, the open surface 21 may be provided in a direction in which the second treatment device door 11 is located, that is, the front surface of the second treatment device T).

The drawer 3 includes a drawer body 31, the upper surface of which is open, and a drawer cover 35 provided at the open surface of the drawer body 31.

The drawer body 31 may be configured to have a hollow hexahedral shape. The drawer cover 35 may be fixed to the drawer body 31 in order to form the upper surface of the drawer body 31.

A drawer panel 33 is provided at the front surface of the drawer body 31. The drawer panel 33 is a member for opening and closing the open surface 21 of the cabinet 2 and, additionally, for pulling out the drawer body 31 from the cabinet 2 or inserting the drawer body 31 into the cabinet 2.

The drawer panel 33 may be provided with a control panel 331 for controlling the operation of the first treatment device L. The control panel 331 is provided to allow the user to input a control command necessary to control components (a water supply unit and a drainage unit) for supplying wash water to the receiving unit 4 and 5 and discharging wash water from the receiving unit 4 and 5, a component (a driving unit) for rotating laundry, and components (a hot air supply unit and a moisture supply unit) for supplying hot air and steam to laundry.

The control panel 331 may be provided with an input unit 332 for allowing the user to input a control command to the first treatment device L and a display unit 333 for allowing the user to check the control command input through the input unit 332 or notifying the user of the progress of execution of the control command input by the user. That is, the display unit 333 may display information about the operation of the first treatment device L.

The first treatment device L may also be configured to wash laundry, to dry laundry, or to wash and dry laundry.

In some examples where the first treatment device L is configured to wash laundry, the drawer cover 35 may be provided with a through hole 351 formed through the drawer cover 35 for allowing the interior of the drawer body 31 and the exterior of the drawer body 31 to communicate with each other and a water supply port 353 formed through the drawer cover 35 for guiding wash water to the receiving unit 4 and 5.

As shown in FIG. 2, the receiving unit 4 and 5 may include a tub 4 provided in the drawer body 31 for providing a wash water receiving space and a drum 5 rotatably provided in the tub 4 for receiving laundry.

The tub 4 is fixed to the drawer 3 via a tub support unit 41. The tub support unit 41 connects the tub 4 and the drawer 3 to each other such that the circumferential surface of the tub 4 is supported by the drawer 3. The tub support unit 41 may be provided with a member for attenuating vibration.

An introduction port 43 for allowing the interior of the tub 4 and the exterior of the tub 4 to communicate with each other is provided at the upper surface of the tub 4. The introduction port 43 is opened and closed by a door 45, which is provided at the tub 4.

The door 45 is rotatably provided at the upper surface of the tub 4 (i.e. the door 49 is provided in order to open and close a portion of the upper surface of the tub 4). The door 45 may be pulled out from the drawer 3 (for example, by hinge rotation) through the through hole 351, which is provided in the drawer cover 35. After pulling out the drawer 3 from the cabinet 2, therefore, the user may open the door 45 in order to introduce laundry into the tub 4 through the introduction port 43.

The tub 4 is provided in the upper surface thereof with an inlet port 47, through which wash water supplied through the water supply port 353, provided in the drawer 3, is introduced into the tub 4. A pipe for connecting the water supply port 353 to the upper surface of the tub 4 may be provided as the inlet port 47. A hole formed through the upper surface of the tub 4 may be provided as the inlet port 47. The hole may be located under the water supply port 353.

The drum 5 may be configured to have the shape of a cylinder, the upper surface of which is open. The drum 5 may be rotated in the tub 4 by a driving unit 6, which is provided outside the tub 4.

The driving unit 6 may include a stator 61 fixed to the tub 4 for generating a rotating magnetic field and a rotor 63 configured to be rotated by the rotating magnetic field. A driving shaft 53, which is fixed to the bottom surface of the drum 5 through the tub 4, is connected to the rotor 63.

As shown in the figure, the driving shaft 53 may be provided to be perpendicular to the bottom surface of the drawer 3, and drum through holes 51 for allowing the interior of the drum 5 and the interior of the tub 4 to communicate with each other may be provided in the outer circumferential surface of the drum 5.

The first treatment device L is connected via a water supply unit 7 to a water source located outside the laundry treatment apparatus 100. The water supply unit 7 may include a water supply pipe 71 for connecting the water supply port 353 to the water source (not shown) and a valve 73 for opening and closing the water supply pipe 71 under the control of a controller.

Wash water received in the tub 4 is discharged out of the cabinet 2 through a drainage unit 8. The drainage unit 8 may include a drainage pipe 81 for guiding the wash water in the tub 4 out of the cabinet 2 and a pump 83 provided in the drainage pipe 81 for discharging the wash water from the tub 4 (under the control of the controller).

The hot air supply unit provided in the first treatment device L may be identical to the second treatment device hot air supply unit.

In some examples where the first treatment device L is configured only to dry laundry, the receiving unit may include only the drum 5, and the hot air supply device provided in the first treatment device L may be configured to supply hot air to the drum 5. In addition, the drawer 3 may be provided with an additional member, to which the driving unit 6 is fixed, for rotatably supporting the drum 5.

In the first treatment device L, the driving unit 6 is fixed to the tub 4. During the operation of the first treatment device L, therefore, vibration generated from the driving unit 6 or the drum 5 may be transmitted to the tub 4.

When vibration is generated from the tub 4, the door 45, which is in a state such that the introduction port 43 is closed, may open the introduction port 43. In addition, when the door 45 opens the introduction port 43 during the operation of the first treatment device L, laundry or wash water may move out from the tub 4.

When the door 45 opens the introduction port 43 during the operation of the first treatment device L, the drawer 3 may not move out from the cabinet 2 due to the door 45 when the user pulls the drawer 3 out from the cabinet 2 after the operation of the first treatment device L is completed.

The first treatment device L may further include a door lock 9 for minimizing a gap between the door 45 and the introduction port 43 to minimize the generation of noise during the operation of the first treatment device L and to prevent the door from opening the introduction port 43 during the operation of the first treatment device L.

In some examples where the door lock 9 is configured such that the door 45 closes the introduction port 43 using magnetic force, a gap between the door 45 and the introduction port 43 may be minimized, whereby it is possible to minimize the generation of vibration and noise attributable to collision between the door 45 and the introduction port 43 during the operation of the first treatment device L.

In addition, if it is possible to minimize collision between the door 45 and the introduction port 43 due to vibration generated from the tub 4 during the operation of the first treatment device L, it is also possible to prevent the door 45 from opening the introduction port 43 during the operation of the first treatment device L.

The door lock 9 may include an actuation unit 93 provided at the door 45 to reciprocate between a first position and a second position and a fixing unit 91 for applying an attractive force to the actuation unit 93 to fix the door 45 to the tub 4 when the actuation unit 93 is located at the first position.

As shown in FIG. 3, the fixing unit 91 may include a magnet, for example, a permanent magnet or an electromagnet, fixed to the tub 4, and the actuation unit 93 may include an actuation body 931 provided in an actuation body receiving unit 451, formed in the door 45, in a reciprocable fashion and a magnetic body 935 fixed to the actuation body 931.

The first position is a position at which the magnetic body 935 faces the fixing unit 91 (see FIG. 3(*a*)), and the second position is a position at which the magnetic body 935 does not face the fixing unit 91 (see FIG. 3(*b*)).

In the actuation body receiving unit 451 is provided an actuation body support unit 933 for pushing the actuation body 931 toward the first position. An example of the actuation body support unit 933 may be a spring.

As long as no external force is applied to the actuation body 931, therefore, the magnetic body 935 is positioned at the first position by the actuation body support unit 933. When the user applies external force to the actuation body 931 such that the magnetic body 935 moves away from the fixing unit 91, the magnetic body 935 moves to the second position.

When the magnetic body 935 is positioned at the first position, an attractive force is generated between the fixing unit 91 and the magnetic body 935. As a result, the door 45 continues to keep the introduction port 43 closed. When the magnetic body 935 is positioned at the second position, on the other hand, no attractive force acts between the fixing unit 91 and the magnetic body 935. As a result, the door 45 is ready to open the introduction port 43.

Furthermore, the actuation body 931 may be provided with a non-magnetic body 937, which faces the fixing unit 91 when the magnetic body 935 is positioned at the second position.

When the magnetic force of the fixing unit 91 is high, a large amount of external force may be required for the door 45 to open the introduction port 43 even through the magnetic body 935 moves to the second position. The non-magnetic body 937 is provided to solve this problem.

The actuation body 931 may reciprocate in one selected from among a width direction X of the door, a height direction Z of the door, and a thickness direction Y of the door. To this end, the actuation body receiving unit 451, provided in the door 45, may be concavely bent in one selected from among the width direction X of the door, the height direction Z of the door, and the thickness direction Y of the door.

In the door lock 9 the magnet may be fixed to the actuation body 931, and the magnetic body 935 and the non-magnetic body 937 may be fixed to the tub 4.

As illustrated in FIG. 4, the door lock 9 may include a fixing unit 91 that includes a first magnet 911 and a second magnet 913 fixed to the tub 4 and in that the actuation unit 93 includes a first magnetic body 9351 and a second magnetic body 9353.

In some examples, when the actuation body 931 is positioned at the first position (see FIG. 4), the first magnetic body 9351 faces the first magnet 911, and the second magnetic body 9353 faces the second magnet 913.

The actuation unit 93 may further include a non-magnetic body configured to face at least one selected from between the first magnet 911 and the second magnet 913 when the actuation body 931 moves to the second position.

The non-magnetic body may be located between the first magnetic body 9351 and the second magnetic body 9353. When the actuation body 931 moves to the second position, the non-magnetic body faces the second magnet 913.

The non-magnetic body may include a first non-magnetic body 9371 fixed to the actuation body 931 such that the first non-magnetic body 9371 faces the first magnet 911 when the actuation body 931 moves to the second position and a second non-magnetic body 9373 fixed to the actuation body 931 such that the second non-magnetic body 9373 faces the second magnet 913 when the actuation body 931 moves to the second position.

The first magnet 911 and the second magnet 913 may be fixed to the actuation body 931, and the first magnetic body 9351, the second magnetic body 9353, the first non-magnetic body 9371, and the second non-magnetic body 9373 may be fixed to the tub 4.

As illustrated in FIG. 5 the door lock 9 may include an actuation body 93, when the actuation body 931 is positioned at the second position, the door 45 is separated from the introduction port 43 due to a repulsive force between the fixing unit 91 and the actuation unit 93.

The actuation unit 93 may include an actuation body 931 provided in the actuation body receiving unit 451 of the door 45 such that the actuation body 931 reciprocates between the first position and the second position and an actuation unit magnet 939 fixed to the actuation body 931, and the fixing unit 91 may include a first fixing unit magnet 911 provided at the tub 4 for applying an attractive force to the actuation unit magnet 939 when the actuation body 931 is positioned at the first position and a second fixing unit magnet 913 provided at the tub 4 for applying a repulsive force to the actuation unit magnet 939 when the actuation body 931 is positioned at the second position.

The actuation unit 93 may further include an actuation body support unit 933 for pushing the actuation body 931 to the first position.

The first fixing unit magnet 911 is fixed to the tub 4 such that the first fixing unit magnet 911 faces the actuation unit magnet 939 in a state in which the first fixing unit magnet 911 and the actuation unit magnet 939 have different polarities, and the second fixing unit magnet 913 is fixed to the tub 4 such that the second fixing unit magnet 913 faces the actuation unit magnet 939 in a state in which the second fixing unit magnet 913 and the actuation unit magnet 939 have the same polarity.

When the actuation body 931 is positioned at the first position, therefore, the door 45 continues to keep the introduction port 43 closed due to the attractive force between the actuation unit magnet 939 and the first fixing unit magnet 911. When the actuation body 931 moves to the second position, the door 45 may be separated from the introduction port due to the repulsive force between the actuation unit magnet 939 and the second fixing unit magnet 913 even though no external force is applied to the door 45.

In some examples, the door lock 9 fixes the door 45, provided at the first treatment device L, to the tub 4. In some other examples, the door lock 9 may fix the second treatment device door 11 to the second treatment device cabinet 1.

The second treatment device T may further include a second treatment device door lock. The second treatment device door lock may include an actuation unit provided at the second treatment device door 11 and a fixing unit provided at the second treatment device cabinet 1 for fixing the second treatment device door 11 to the second treatment device cabinet 1 based on the position of the actuation unit 93.

When the actuation unit is positioned at the first position, the second treatment device door 11 may continue to keep the second treatment device introduction port 151 closed due to the attractive force between the actuation unit and the fixing unit. When the actuation unit is positioned at the second position, on the other hand, the second treatment device door 11 may be ready to open the second treatment device introduction port 151.

Although implementations have been illustrated and described above, it will be apparent to those skilled in the art that the implementations are provided to assist understanding of the present disclosure and the present disclosure is not limited to the above described implementations. Various modifications and variations can be made without departing from the spirit or scope of the present disclosure.

The invention claimed is:

1. A laundry treatment apparatus comprising:
- a receiving unit configured to receive laundry;
- an introduction port configured to allow the receiving unit to communicate with an outside of the laundry treatment apparatus;
- a door configured to open and close the introduction port;
- an actuation unit comprising:
  - an actuation body provided at the door and configured to move between a first position and a second position; and
  - a magnetic body fixed to the actuation body; and
- a fixing unit that is configured to fix the door to the introduction port by an attractive force based on the actuation unit being positioned at the first position, and that is configured to separate the door from the introduction port based on the actuation unit being positioned at the second position, the fixing unit comprising a magnet fixed to the receiving unit and configured to apply an attractive force to the magnetic body based on the actuation body being moved to the first position,
- wherein the actuation unit further comprises a non-magnetic body fixed to the actuation body, and the non-magnetic body is configured to face the magnet based on the actuation body being moved to the second position.

2. The laundry treatment apparatus according to claim 1, further comprising:
- an actuation body receiving unit that is provided in the door and that is configured to receive the actuation body; and
- an actuation body support unit provided in the actuation body receiving unit and that is configured to push the actuation body to the first position while elastically supporting the actuation body.

3. The laundry treatment apparatus according to claim 1, further comprising:
- a cabinet configured to provide a space to receive the receiving unit; and
- a through hole provided in the cabinet and configured to communicate with the introduction port.

4. The laundry treatment apparatus according to claim 1, further comprising:
- a cabinet;
- a drawer provided in the cabinet and configured to provide a space to receive the receiving unit; and
- a through hole provided in the drawer, the through hole being located above the door for allowing the door to be hingedly rotated toward an outside of the drawer.

5. The laundry treatment apparatus according to claim 4, wherein:
- the fixing unit is fixed to the receiving unit, and
- the actuation unit is configured to move in a width direction of the door or in a height direction of the door.

6. The laundry treatment apparatus according to claim 5, wherein the actuation unit is configured to move in a width direction of the door.

7. The laundry treatment apparatus according to claim 5, wherein the actuation unit is configured to move in a height direction of the door.

8. A laundry treatment apparatus comprising:
- a receiving unit configured to receive laundry;
- an introduction port configured to allow the receiving unit to communicate with an outside of the laundry treatment apparatus;
- a door configured to open and close the introduction port;
- an actuation unit comprising:
  - an actuation body provided at the door and configured to move between a first position and a second position; and
  - a magnetic body fixed to the actuation body; and
- a fixing unit that is configured to fix the door to the introduction port by an attractive force based on the actuation unit being positioned at the first position, and that is configured to separate the door from the introduction port based on the actuation unit being positioned at the second position, the fixing unit comprising a magnet fixed to the receiving unit and configured to apply an attractive force to the magnetic body based on the actuation body being moved to the first position,
- wherein the magnetic body comprises a first magnetic body and a second magnetic body fixed to the actuation body such that the first magnetic body and the second magnetic body are spaced apart from each other by a predetermined distance, and the magnet comprises a first magnet configured to face the first magnetic body based on the actuation body being positioned at the first position, and a second magnet configured to face the second magnetic body based on the actuation body being positioned at the first position.

9. The laundry treatment apparatus according to claim 8, wherein the actuation unit further comprises a non-magnetic body provided between the first magnetic body and the second magnetic body such that the non-magnetic body is configured to face the first magnet or the second magnet based on the actuation body being moved to the second position.

10. A laundry treatment apparatus comprising:

a receiving unit configured to receive laundry;

an introduction port configured to allow the receiving unit to communicate with an outside of the laundry treatment apparatus;

a door configured to open and close the introduction port;

an actuation unit provided at the door and configured to move between a first position and a second position; and a fixing unit that is configured to fix the door to the introduction port by an attractive force based on the actuation unit being positioned at the first position, and that is configured to separate the door from the introduction port based on the actuation unit being positioned at the second position, wherein:

the fixing unit comprises a magnetic body fixed to the receiving unit, and the actuation unit comprises:

an actuation body provided at the door and configured to move between the first position and the second position; and a magnet fixed to the actuation body and configured to apply an attractive force to the magnetic body based on the actuation body being moved to the first position, and the fixing unit further comprises a non-magnetic body fixed to the receiving unit such that the non-magnetic body is configured to face the magnet based on the actuation body being moved to the second position.

* * * * *